US006805219B2

(12) United States Patent
Yasuda et al.

(10) Patent No.: US 6,805,219 B2
(45) Date of Patent: Oct. 19, 2004

(54) ENGINE COVER

(75) Inventors: Zenichi Yasuda, Nishikasugai-gun (JP); Yutaka Ogasawara, Nishikasugai-gun (JP); Yoshikazu Hirose, Nishikasugai-gun (JP); Yasuo Sakakibara, Nishikasugai-gun (JP); Masahiro Ogata, Nishikasugai-gun (JP)

(73) Assignee: Toyoda Gosei Co., Ltd., Aichi-ken (JP)

( * ) Notice: Subject to any disclaimer, the term of this patent is extended or adjusted under 35 U.S.C. 154(b) by 0 days.

(21) Appl. No.: 10/205,207

(22) Filed: Jul. 26, 2002

(65) Prior Publication Data

US 2003/0019461 A1 Jan. 30, 2003

(30) Foreign Application Priority Data

Jul. 27, 2001 (JP) ..... P2001-227568

(51) Int. Cl.[7] ..... F01N 11/00

(52) U.S. Cl. ..... 181/204; 181/175; 181/198; 181/205; 181/208; 415/119; 123/198 R; 123/198 E

(58) Field of Search ..... 181/175, 184–185, 181/198, 202–211, 182, 293, 290, 291, 292; 415/119; 123/195 S, 198 R, 198 E, 198 F, 195 C; 248/672; 428/332; 184/106

(56) References Cited

U.S. PATENT DOCUMENTS

| | | | | | |
|---|---|---|---|---|---|
| 4,128,683 | A | * | 12/1978 | Nomura et al. | 428/138 |
| 4,129,672 | A | * | 12/1978 | Momura et al. | 428/138 |
| 4,498,433 | A | * | 2/1985 | Ogawa | 123/90.38 |
| 5,545,861 | A | * | 8/1996 | Morimoto | 181/290 |
| 5,744,763 | A | * | 4/1998 | Iwasa et al. | 181/286 |
| 5,971,099 | A | * | 10/1999 | Yasuda et al. | 181/286 |
| 6,454,527 | B2 | * | 9/2002 | Nishiyama et al. | 415/119 |

FOREIGN PATENT DOCUMENTS

| | | |
|---|---|---|
| JP | 10-069278 | 3/1998 |
| JP | 10-103077 | 4/1998 |
| JP | 10-331636 | 12/1998 |
| JP | 2001-214752 | 8/2001 |

* cited by examiner

*Primary Examiner*—David Martin
*Assistant Examiner*—Renata McCloud
(74) *Attorney, Agent, or Firm*—Posz & Bethards, PLC

(57) ABSTRACT

An engine cover has a cover body having a through hole penetrating both sides of the cover body in an area opposed to a resonant space in which resonant sounds are generated. An opening of the through hole is covered with the sound absorbing member layer. Because a part of the resonant space is open, resonant sounds generated in the resonance space are decreased.

21 Claims, 4 Drawing Sheets

ENGINE COVER

BACKGROUND OF THE INVENTION

The present invention relates to an engine cover to be employed in an automobile or the like, and more particularly to a structure of the engine cover in which noises can be further decreased.

Recently, in an engine room of an automobile, it has been customary that an engine cover is provided in an upper part of a cylinder head cover of an engine. This engine cover is formed of thermoplastic resin or the like into a plate-like shape, and provided with ornamental characters or patterns which have been drawn on its surface with light tone of warm colors, so that its aesthetic appearance may be enhanced.

It is also required for the engine cover to insulate sounds emitted from the engine so as to decrease noises leaking from the engine room. For this purpose, there has been employed an engine cover composed of a hard cover body and a layer of sound absorbing member which is stacked to a surface of the cover body opposed to the engine. By attaching the sound absorbing member layer in this manner, the sound absorbing member layer absorbs the sounds emitted from the engine. Accordingly, leak of the sounds to an exterior of the automobile can be more effectively restrained owing to synergistic effect between sound absorption by the sound absorbing member layer and sound insulation by the cover body.

As the sound absorbing member to be employed in such the sound absorbing layer, there have been known fiber type sound absorbing members such as non-woven fabrics of synthetic resin formed of PET or the like, non-woven fabrics made of natural fibers, glass wool laminates, etc., or alternatively, foam type sound absorbing members such as urethane foam, foamed olefin, etc.

However, when the noises have been measured at a position apart from a surface of the engine cover by a determined distance, it has been found that due to provision of the engine cover, sound pressure levels of the noises in a relatively low sound range having frequencies of about 300 to 800 Hz have been rather increased. Sufficient absorption of the noises in such a frequency range is difficult with the sound absorbing member layer which has been heretofore employed.

It is considered that this phenomenon is due to resonance occurring in a somewhat closed space which is formed between the engine cover and engine members.

SUMMARY OF THE INVENTION

The present invention has been made in view of such circumstances as described above, and an object of the present invention is to decrease noises from an engine all the more, by further decreasing resonant sounds.

A feature of an engine cover according to the present invention for solving the above described problem lies in the engine cover held by engine members, characterized in that the engine cover comprises a cover body in a plate-like shape and a sound absorbing member layer stacked to a surface on a back face side of the cover body, the cover body including a through hole penetrating both sides of the cover body in an area opposed to a resonant space which is formed between the cover body and the engine members, and in which resonant sounds are generated, wherein an opening of the through hole on the back face side of the cover body is covered with the sound absorbing member layer.

This sound absorbing member layer has preferably air permeability.

Moreover, it is desirable that an opening area of the through hole is 100 $mm^2$ or more, and an opening rate of the through hole is 45% or less.

DETAILED DESCRIPTION OF THE PREFERRED EMBODIMENTS

Figure 1:
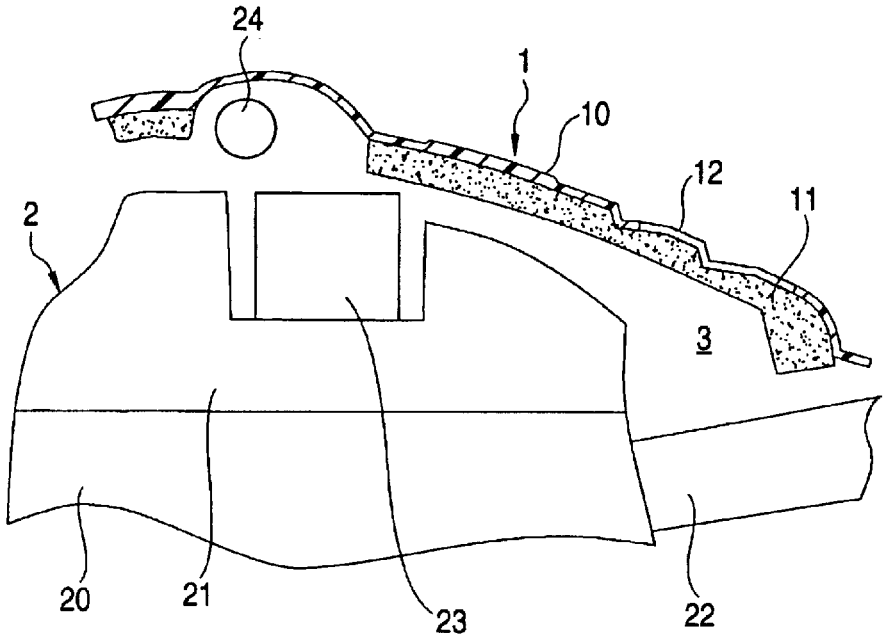
FIG. 1 is a schematic sectional view of engine members and an engine cover, showing a first embodiment of the present invention.
Figure 2:
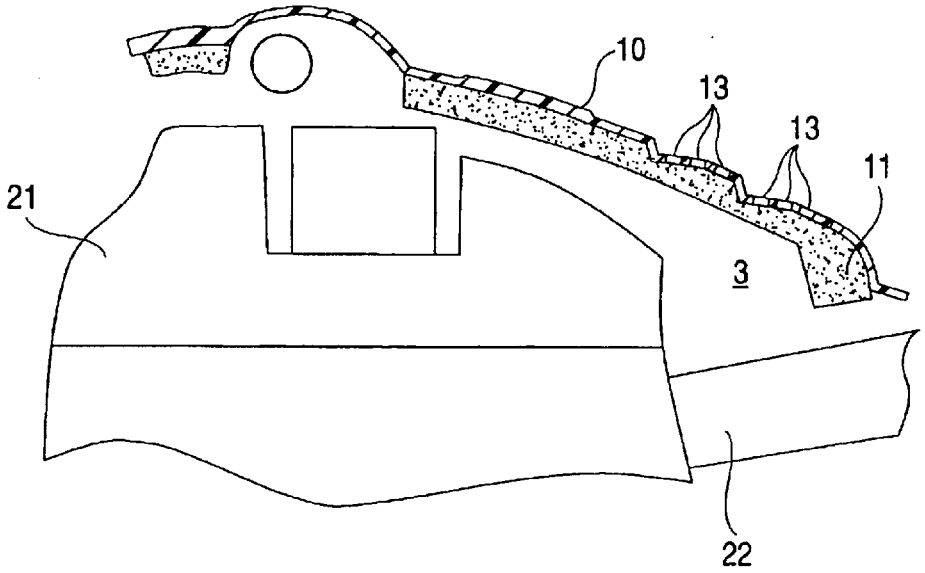
FIG. 2 is a schematic sectional view of the engine members and the engine cover, showing a second embodiment of the present invention.

According to the engine cover of the present invention, the cover body has the through hole penetrating both sides of the cover body in an area opposed to the resonant space which is formed between the cover body and the engine members and in which the resonant sounds are generated. Because a part of the resonant space is thus made open, the resonant sounds generated in the resonant space will be decreased.

In addition, because the structure is such that an opening of the through hole which opens in the back face side of the cover body is covered with the sound absorbing member layer, the noises leaking through the through hole can be decreased, and particularly, the noises in a relatively high sound range having a frequency range above 1000 Hz can be decreased.

It is to be noted here that the engine members mean the generic name including an engine body consisting of cylinders and pistons, a device for supplying fuel and air to the engine body, a cam mechanism for controlling air intake and exhaust, oil circulating device, and so on. The engine cover according to the present invention is assembled to the engine so as to cover at least a part of these members.

As the resonant space, there are exemplified a space formed between the engine body and the engine cover, a space formed between an intake manifold and the engine cover, and so on. This resonant space can be easily detected by measuring distribution of sound pressure on a surface of the engine while driving, by means of a noise meter or the like.

The cover member which has been formed in a plate-like shape so as to cover an upper part of the engine members in the same manner as in the conventional ones is employed. An outer shape, ornaments, tone of colors and so on of the cover body are not particularly limited. The material for the cover body may include various types of thermoplastic resin, fiber reinforced thermoplastic resin, powder reinforced thermoplastic resin, thermosetting resin or metals, and is not particularly limited.

A circumferential edge of the cover body on a back face side is preferably such that its entire circumference may cover as large areas as possible of upper faces of the engine members. This will further improve sound insulating performance. It is also desirable that the circumferential edge of the cover body on the back face side may be abutted against the engine members to form an enclosed space between the cover body and the surfaces of the engine members. This will further improve the sound insulating performance. This can be effected only by abutting the entire circumference of the circumferential edge of the cover body on the back face side against the surfaces of the engine members via sealing members such as urethane foam or rubber seal, etc. In some cases, such enclosed space may become a resonant space, and on such occasions, a through hole may be formed so as to be opposed to the enclosed space.

It would be sufficient that the sound absorbing member layer has air permeability, and can absorb energy of sound waves with vibration of fibers in the sound absorbing member layer while the sound waves pass through voids in the material. Such sound absorbing member may includes as in the conventional one, fiber type sound absorbing member such as non-woven fabric of synthetic resin formed of PET or the like, non-woven fabric made of natural fibers, glass wool laminates, etc., or alternatively, foam type sound absorbing member such as urethane foam, foamed olefin, etc. Thickness, degree of the air permeability and so on of the sound absorbing member layer can be appropriately selected according to purposes.

It is desirable that an opening area of the through hole is 100 $mm^2$ or more, and an opening rate of the through hole is 45% or less. In case where a plurality of the through holes are provided, it would be sufficient that the total value falls within this range. With the through hole having a smaller opening area than 100 $mm^2$, an effect of providing the through hole will not be realized, and the noises caused by the resonant sounds cannot be sufficiently decreased. The opening area more than 400 $mm^2$ is more desirable. Moreover, in case where the opening rate exceeds 45%, the noises in the high frequency range above 1000 Hz cannot be sufficiently decreased. The opening rate less than 30% is more desirable.

The opening area and the opening rate depend on the air permeability and the thickness of the sound absorbing member layer too, and therefore, the opening area and the opening rate are desirably determined by trial and error. The shape of the through hole may be either of a perfect circle, an ellipse, a square hole, a slit-like shape, but is not particularly limited.

It is also desirable that on the back face side of the cover body, there is provided a partition wall which is projected from the cover body and opposed to a high pressure area having a relatively high sound pressure level on the surfaces of the engine members. This will further enhance the sound insulating performance. However, in case where a resonant space may be created by a presence of the partition wall, it is desirable to form an additional through hole in a corresponding area.

The partition wall is desirably provided in such a manner that the space surrounded by the partition wall and the cover body may completely cover the high sound pressure area. In case where a plurality of the high sound pressure areas exist, a plurality of the partition walls are desirably provided so that the respective spaces may cover the respective high sound pressure areas. When even a part of the high sound pressure areas is exposed from the above described spaces, the sound insulating performance will be deteriorated.

Further, it is desirable to form the partition wall tubular and endless. In this case, the shape of the partition wall may be endless by itself, or may become endless by being connected with the circumferential wall of the engine cover.

A tip end of the partition wall may be abutted against the surfaces of the engine members or may be remote from the surfaces of the engine members by a determined distance. The highest sound insulating performance can be obtained, when the tip end of the partition wall is in contact with the surface of the engine, and an enclosed space is formed between the partition wall, the cover body and the engine members. However, in order to create the enclosed space, a soft sealing member such as urethane foam, rubber seal and so on must be provided on an interface between the tip end of the partition wall and the surfaces of the engine members, which will lead to an increase of cost. Therefore, it is practical that the partition wall is arranged at a determined distance from the surfaces of the engine members. In this case, the distance is preferably less than 10 mm. In case where the distance between the tip end of the partition wall and the surfaces of the engine members is 10 mm or more, there will be an increased probability that the sound waves from the engine members may escape to an exterior of the partition wall, and the sound insulating performance may be deteriorated.

EXAMPLES

The present invention will be more specifically described hereunder by way of examples and comparative examples.

Example 1

An engine cover 1 as shown in FIG. 1 is composed of a plate-like cover body 10 which is formed of ABS, and a layer 11 of sound absorbing member made of non-woven fabric of PET which is integrally stacked on a back face side of the cover body 10.

Engine members 2 to be covered with this engine cover include an engine body 20, a cylinder head cover 21 fixed to an upper part of the engine body 20, an intake manifold 22 for supplying combustion air to the engine body 20, a plug 23 and a harness member 24. There is formed a resonant space 3 between the engine cover 1, and both the cylinder head cover 21 and the intake manifold 22.

Then, a single through hole 12 is formed in an area of the cover body 10 opposed to the resonant space 3 so as to penetrate both sides of the cover body, and an opening of the through hole 12 which opens on the back face side of the cover body 10 is covered with the sound absorbing member layer 11. This through hole 12 is in a substantially elliptical shape elongated in a longitudinal direction of the cover body 10 (in a perpendicular direction with respect to a plane of the drawing). Its shorter diameter is about 20% of a lateral length (in a lateral direction with respect to the plane of the drawing) of the cover body 10, and its longer diameter is about 40% of a longitudinal length of the cover body 10. The opening area is 14400 $mm^2$, and the opening rate is 8%.

Because the engine cover is provided on the engine members in such a manner as described above, noises occurring from the engine members 2 can be effectively insulated by means of the sound absorbing member layer 11 and the through hole 12.

Example 2

This example has the same structure as the example 1 except that a plurality of round through holes 13 penetrating both sides of the cover body 10 are formed in an area opposed to the resonant space 3.

A diameter of the through hole 13 is 4 mm, and a plurality of the through holes are uniformly formed in the area corresponding to the through hole 12 in the example 1 so that the total opening rate may be about 40%.

Comparative Example 1

The comparative example 1 has the same structure as the example 1 except that the cover body 10 is not provided with the through hole 12.

<Tests and Evaluations>

The engine covers 1 of the above described example 1, example 2, and the comparative example 1 were respectively fixed to stud bolts (not shown) provided on the cylinder head covers 21 via collars, by means of nuts. A microphone was arranged at a position of 1 m above a center of the engine cover 1, and the engine was actuated to measure sound pressure levels in a state of idling.

Figure 3:
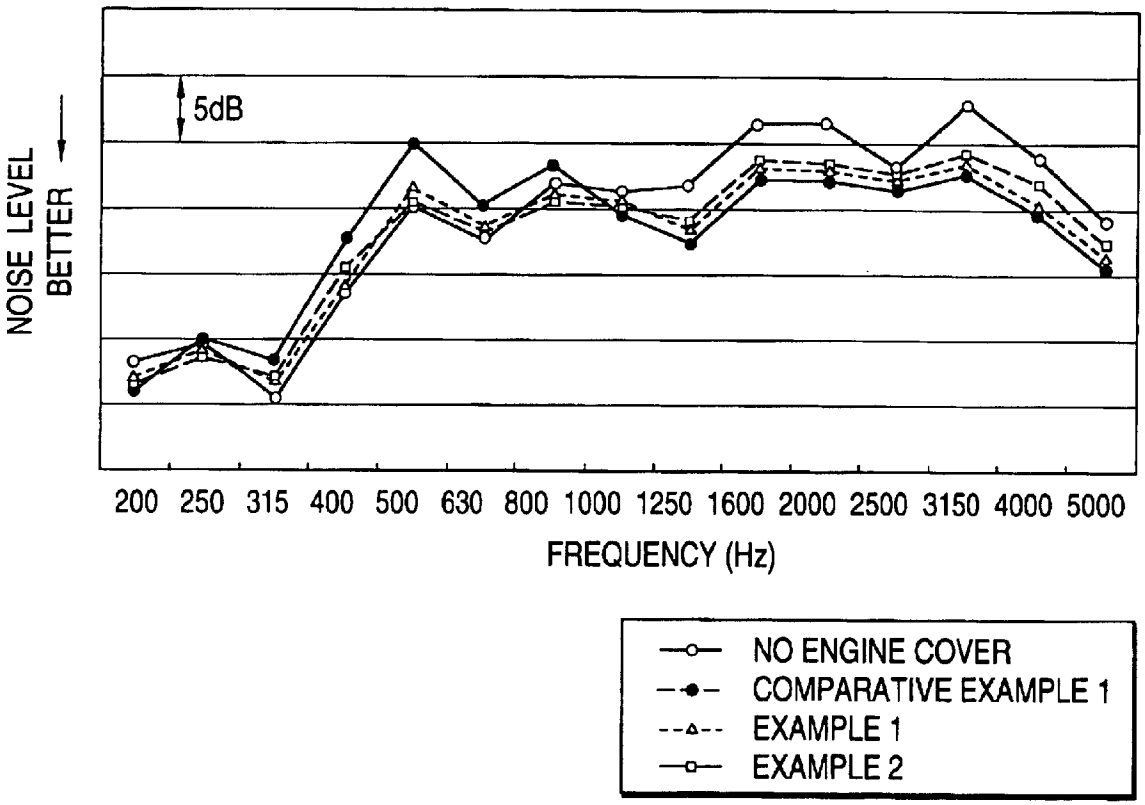
FIG. 3 is a graph showing relation between frequency and sound pressure level.

Sound waves which have permeated through the engine cover 1 were detected by means of the microphone, and the detected sound waves were measured by means of a real time analyzer to obtain the sound pressure levels at respective frequencies. For comparison, the sound pressure levels of the engine members 2 provided with no engine cover were also measured in the same manner. The results are shown in FIG. 3. In FIG. 3, the Y axis represents the sound pressure levels (dB) in which one graduation is 5 dB, and upward positions of the Y axis indicate higher sound levels while downward positions indicate lower sound levels.

It is learned from FIG. 3 that in case where the engine covers 1 of the example 1, example 2 and the comparative example 1 have been mounted on the engine members, the noises have been decreased in the frequency range above 1000 Hz, as compared with the case where the engine cover is not provided. It is considered that this is attributed to the sound insulating effect by the cover body 10 and the sound absorbing effect by the sound absorbing member layer 11.

In the frequency range above 1000 Hz, the noise decreasing effect is lower in the example 2 as compared with the comparative example 1. This is due to the fact that the sounds which have permeated through the sound absorbing member layer 11 cannot be insulated because the cover body 10 is not present in the area of the through holes 13. However, it is found that the sound insulating performance of the example 1 is substantially equal to the comparative example 1, though rather inferior to the comparative example 1, because the opening rate in the example 1 is smaller than in the example 2.

On the other hand, in a frequency range below 1000 Hz, it is found that a large resonant sound is generated at frequencies near 500 Hz in the comparative example 1, because the engine cover has been provided. Restraining effects against this resonant sound are recognized in the example 1 and the example 2. It is apparent that the restraining effects are attributed to provision of the through holes 12, 13.

Example 3

Employing the same engine cover 1 as in the example 1 except that the shape of the through hole 12 is different, differences in noise levels depending on variation of the opening area of the through hole 12 were measured. A single through hole 12 in a slit-like shape was formed, so that its width may have three standards, namely, 1 mm, 2 mm and 4 mm, and it length may have three standards, namely, 50 mm, 100 mm and 200 mm. The through holes 12 with various different combinations of the widths and the lengths were provided. The through hole 12 is formed at a front end portion of the cover body 10, as shown in FIG. 1, starting from a central position in a longitudinal direction and extending to the left. The opening rate was 0.4% at most.

Comparative Example 3

The comparative example 3 is the same as the example 3 except that the sound absorbing member layer 11 is not provided.

<Tests and Evaluations>

Figure 4:
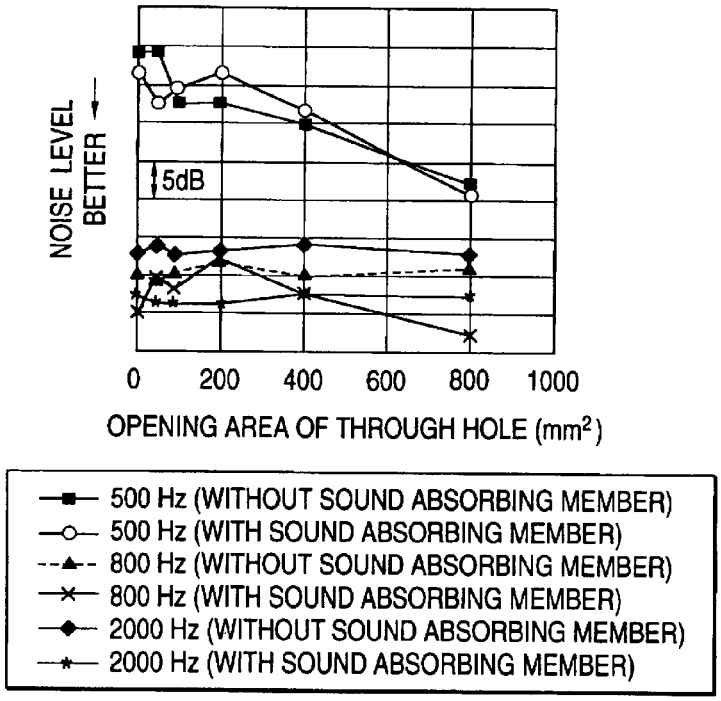
FIG. 4 is a graph showing relation between an opening area of a through hole and noise level.

In the same manner as the above described tests, noise levels at frequencies of 500 Hz, 800 Hz and 2000 Hz during idling were measured with the respective engine covers. The results are shown in FIG. 4 as relative values with respect to the opening areas of the through hole 12. One graduation of the noise level is 5 dB.

It is learned from FIG. 4 that in order to decrease noises in a low frequency range as low as 500 Hz, the opening area of the through hole 12 may preferably be 100 $m^2$ or more, and more desirably 400 $mm^2$ or more. As for noises in the high frequency range, it is found that the noise level can be decreased, within a scope of this test condition, by providing the sound absorbing member layer 11, irrespective of presence of the through hole 12 and degree of the opening area.

Example 4

Figure 5:
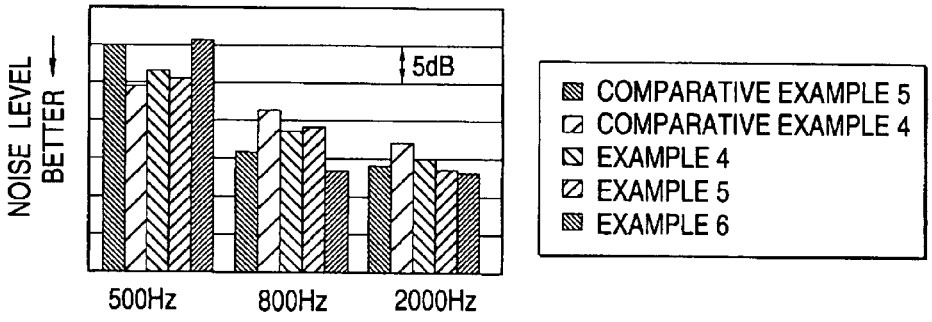
FIG. 5 is a graph showing relation between the frequency and the noise level with the engine covers of the examples 4 to 6 and the comparative examples 4 and 5.

Employing the cover body 10 provided with the through hole 12 in a slit-like shape having a width of 2 mm and a length of 200 mm (the opening area is 400 $mm^2$, the opening rate is 0.2%) which was prepared in the example 3, differences in the noise level due to variation in material for the sound absorbing member layer 11 have been measured in the same manner as in the example 3. Non-woven fabric of PET (500 $g/m^2$, thickness is 10 mm) has been employed as the material for the sound absorbing member layer 11. The results are shown in FIG. 5. One graduation of the noise level is 5 dB.

Example 5

The example 5 is the same as the example 4 except that non-woven fabric of PET (500 $g/m^2$, thickness is 20 mm) has been employed as the material for the sound absorbing member layer 11.

Example 6

The example 6 is the same as the example 4 except that closed-cell urethane foam (thickness is 15 mm) has been employed as the material for the sound absorbing member layer 11.

Comparative Example 4

The comparative example 4 is the same as the example 4 except that the sound absorbing member layer 11 is not provided.

Comparative Example 5

The comparative example 5 is the same as the example 4 except that the through hole 12 is not formed.

<Evaluations>

It is found from FIG. 5 that with the engine cover of the comparative example 4, the noise level is high in the high frequency range, and there is a leak of sound through the through hole 12 because there is no sound absorbing member layer 11 provided. With the engine cover of the comparative example 5, resonant sounds are hardly decreased because it has no through hole 12, and the noise level is high in the low frequency range. Further, with the engine cover of the example 6, the noise level in the low frequency range is approximately the same as the comparative example 5, and so, it is considered that the through hole 12 has not functioned because the closed-cell urethane foam has not air permeability.

With the engine covers of the examples 4 and 5, noises can be decreased over all the ranges from the low frequency range to the high frequency range. It is apparent that this is attributed to the fact that the through hole 12 has been formed, the opening area and the opening rate of the through hole 12 have been optimumly determined, the sound absorbing member layer 11 has been provided, and further, the material having air permeability has been employed as the sound absorbing member layer 11.

There is seen no significant difference between the example 4 and the example 5, and so, there is no difference in effects due to variation in the thickness of the sound absorbing member layer 11 recognized under this test conditions.

Figure 6:
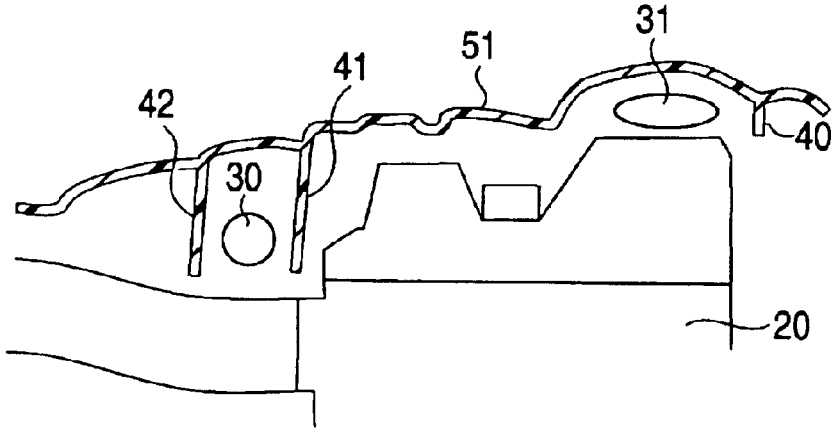
FIG. 6 is a schematic sectional view of engine members and an engine cover, showing a third embodiment of the present invention.

The third embodiment where partition walls are provided on an engine cover body is shown in FIG. 6.

As shown in FIG. 6, an engine cover body 51 is provided with partition walls 40, 41 and 42 extending from a backside of the engine cover body 51.

The partition walls 40 and 41 forms an endless ring shape by continuing to each other. Also, the partition walls 41 and 42 forms an endless ring shape by continuing to each other.

The engine 2 which is covered with the engine cover 51 includes the engine main body 20 and a delivery pipe 30 and a harness member 31. Outer surfaces of the engine main body 20 and the delivery pipe 30 are high sound pressure portions where the sound pressure level is relatively higher than other portions.

The partition walls 41, 42 and 43 are formed so as to surround the delivery pipe 30 and the engine main body 20. As a result, by disposing the engine cover 51 on or above the engine 2, the noise emitted from the surface of the engine body 20 is effectively insulated by the partition walls 41 and 42. Also the noise emitted by the delivery pipe 30 is effectively insulated by the partition walls 40 and 41. Incidentally, tip ends of the partition walls 40, 41 and 43 remote from the surface of the engine member 2 in this example, the partition walls may be abutted against the surfaces of the engine member 2.

Although it is not shown in FIG. 6, the through holes as described in the foregoing examples may be formed on the engine cover 51 in accordance with the resonant space generated. Further in case where a resonant space is created by a presence of the partition walls, additional through holes may be formed on the engine cover at a corresponding portion.

According to the engine cover of the present invention, noises by the resonant sounds in the resonant space can be effectively decreased, and noises from the engine can be decreased all the more in cooperation with the sound absorbing function by the sound absorbing member layer.

What is claimed is:

1. An engine cover capable of being held by engine members comprising:

a cover body in a plate-like shape;

a sound absorbing member layer stacked to a surface on a back face side of said cover body;

a through hole formed on and penetrating said cover body in an area opposed to a resonant space, which is formed between said cover body and said engine members and in which resonant sounds are generated; and at least one partition wall projecting from a back surface of said cover body; wherein said partition wall is opposed to a high pressure area having a high sound pressure level on a surface of the engine members and wherein an opening of said through hole on the back face side of said cover body is covered with said sound absorbing member layer.

2. An engine cover as claimed in claim 1, wherein said sound absorbing member layer has air permeability.

3. An engine cover as claimed in claim 1, wherein an opening area of said through hole is 100 $mm^2$ or more, and an opening rate of said through hole is 45% or less.

4. An engine cover as claimed in claim 3, wherein an opening area of said through hole is 400 $mm^2$ or more.

5. An engine cover as claimed in claim 3, wherein an opening rate of said through hole is 30% or less.

6. An engine cover as claimed in claim 1, wherein said sound absorbing member is constituted by a fiber type sound absorbing member.

7. An engine cover as claimed in claim 6, wherein said fiber type sound absorbing member is a non-woven fabric of PET.

8. An engine cover as claimed in claim 1, wherein said sound absorbing member is constituted by a foam type sound absorbing member.

9. An engine cover as claimed in claim 7, wherein said foam type sound absorbing member is a closed-cell urethane foam.

10. An engine cover as claimed in claim 1, wherein said through hole is shaped in a slit.

11. An engine cover as claimed in claim 1, wherein said through hole is shaped in an elliptical shape.

12. An engine cover capable of being coupled to engine members comprising:

a cover body having a plate shape;

a sound absorbing layer attached to a back surface of the cover body;

a through hole penetrating the cover body and communicating with a resonant space, the resonant space formed between the cover body and the engine members, the resonant space capable of producing resonance; and a partition projecting from the back surface of the cover body; the partition located opposite an area on a surface associated with the engine members, the area having a high sound pressure level, wherein an opening of the through hole on the back surface of the cover body is covered with the sound absorbing layer.

13. An engine cover capable of being coupled to engine members comprising:

a cover body having a plate shape;

a sound absorbing layer attached to a back surface of the cover body;

a through hole penetrating the cover body and communicating with a resonant space, the resonant space formed between the cover body and the engine members, the resonant space capable of producing resonance, wherein an opening of the through hole on the back surface of the cover body is covered with the sound absorbing layer, and wherein a shape of the through hole includes an elliptical shape.

14. An engine cover capable of being held by engine members comprising:

a cover body in a plate-like shape;

a sound absorbing member layer stacked to a surface on a back face side of said cover body; and a through hole formed on and penetrating said cover body in an area opposed to a resonant space, which is formed between said cover body and said engine members and in which resonant sounds are generated;

wherein an opening of said through hole on the back face side of said cover body is covered with said sound absorbing member layer, and wherein said through hole is shaped in an elliptical shape.

15. An engine cover according to claim 14, wherein an opening area of said through hole is 100 $mm^2$ or more, and an opening rate of said through hole is 45% or less.

16. An engine cover according to claim 15, wherein an opening area of said through hole is 400 $mm^2$ or more.

17. An engine cover according to claim 15, wherein an opening rate of said through hole is 30% or less.

18. An engine cover according to claim 14, wherein said sound absorbing member is constituted by a fiber type sound absorbing member.

19. An engine cover according to claim 14, wherein said sound absorbing member is constituted by a foam type sound absorbing member.

20. An engine cover according to claim 18, wherein said fiber type sound absorbing member is a non-woven fabric of PET.

21. An engine cover according to claim 19, wherein said foam type sound absorbing member is a closed-cell urethane foam.

* * * * *